US009093769B2

(12) United States Patent
Youn et al.

(10) Patent No.: US 9,093,769 B2
(45) Date of Patent: Jul. 28, 2015

(54) HIGH VOLTAGE CONNECTOR

(75) Inventors: Young Jun Youn, Daegu-si (KR); Jong Sug Kim, Gumi-si (KR)

(73) Assignee: LG ELECTRONICS INC., Seoul (KR)

( * ) Notice: Subject to any disclaimer, the term of this patent is extended or adjusted under 35 U.S.C. 154(b) by 198 days.

(21) Appl. No.: 13/816,712

(22) PCT Filed: Aug. 11, 2011

(86) PCT No.: PCT/KR2011/005874

§ 371 (c)(1),
(2), (4) Date: Feb. 12, 2013

(87) PCT Pub. No.: WO2012/026696

PCT Pub. Date: Mar. 1, 2012

(65) Prior Publication Data

US 2013/0137289 A1 May 30, 2013

(30) Foreign Application Priority Data

Aug. 13, 2010 (KR) ..... 10-2010-0078272

(51) Int. Cl.

| | |
|---|---|
| ***H01R 13/627*** | (2006.01) |
| ***H01R 13/40*** | (2006.01) |
| ***H01R 13/53*** | (2006.01) |
| ***H01R 13/641*** | (2006.01) |

(52) U.S. Cl.
CPC ..... *H01R 13/40* (2013.01); *H01R 13/53* (2013.01); *H01R 13/641* (2013.01)

(58) Field of Classification Search
USPC ..... 439/352, 152, 595, 489, 135–140; 200/51.1, 526, 292
See application file for complete search history.

(56) References Cited

U.S. PATENT DOCUMENTS

| | | | | | |
|---|---|---|---|---|---|
| 3,293,637 | A | * | 12/1966 | Abbott et al. | 341/2 |
| 3,407,373 | A | * | 10/1968 | Brown et al. | 439/23 |
| 3,588,467 | A | * | 6/1971 | Grosjean | 219/214 |
| 3,598,948 | A | * | 8/1971 | Bowen et al. | 200/526 |
| 3,758,002 | A | * | 9/1973 | Doyle et al. | 222/146.3 |
| 4,038,505 | A | * | 7/1977 | Gasparaitis et al. | 200/51.1 |
| 6,415,957 | B1 | * | 7/2002 | Michaels et al. | 222/146.3 |
| 6,978,912 | B2 | * | 12/2005 | Taylor et al. | 222/146.3 |
| 6,978,914 | B2 | * | 12/2005 | Furner et al. | 222/402.1 |
| 7,641,499 | B1 | | 1/2010 | George et al. | |

FOREIGN PATENT DOCUMENTS

| | | |
|---|---|---|
| KR | 10-0774654 B1 | 11/2007 |
| KR | 10-0833802 B1 | 5/2008 |

* cited by examiner

*Primary Examiner* — Jean F Duverne
(74) *Attorney, Agent, or Firm* — McKenna Long & Aldridge LLP

(57) ABSTRACT

The present invention relates to a high voltage connector in which an interlock terminal and a power connection terminal to which a high voltage is applied are sequentially connected or disconnected by rotation, thereby minimizing the size of the connector and allowing a user to check whether each of the terminals is connected or not. The high voltage connector of the present invention comprises: a plug housing inside which is installed a power connection terminal and an interlock connection plug; a cap housing inserted into the inside of the plug housing, and inside which are installed an interlock connecting tab which is capable of connection with the interlock connection plug, and a power connection terminal tab which is capable of connection with the power connection terminal; and a cover housing installed on the top of the cap housing for connecting or disconnecting the power connection terminal tab and the interlock connecting tab with the power connection terminal and the interlock connection plug by inserting or withdrawing the cap housing from the inside of the plug housing by rotation.

14 Claims, 12 Drawing Sheets

HIGH VOLTAGE CONNECTOR

TECHNICAL FIELD

The present invention relates to a connector, and more particularly to a high voltage connector in which an interlock terminal and a power connection terminal to which a high voltage is applied are sequentially connected or disconnected by rotation, thereby minimizing the size of the connector and allowing a user to check if each of the terminals is connected.

BACKGROUND ART

Generally, a connector installed at a wire to which a high-voltage current is applied has a double cutoff structure for safety. Particularly, for a hybrid vehicle to which high-voltage current is applied, this double cutoff structure is essential.

More specifically, since high-voltage current is applied to the connector, connection or disconnection of terminals of a power switch can cause arcing between the terminals, each of which acts as an electrode in this case. To prevent possible damage to a product due to the arc, an interlock switch, to which an electric current is applied at a voltage lower than that for the power switch, is further installed.

For such connector, the interlock switch to which a low-voltage current is applied is first connected or disconnected to apply or cut off power and then the power switch to which a high-voltage current is applied is connected or disconnected to prevent arcing between the terminals which is caused by application of a large amount of high-voltage current at a time.

Such connector has a first housing provided with a first power terminal and a first interlock terminal and a second terminal inserted into the first terminal. A second power terminal and a second interlock terminal to be connected respectively to the first power terminal and the first interlock terminal are installed inside the second housing such that the lengths of the first and second interlock terminals are shorter than those of the first and second power terminals.

In the connector having the above structure, when the second housing is inserted into the first housing, the first and second power terminals are first connected and then as the second housing is further inserted into the first housing the first and second interlock terminals having shorter lengths than the power terminals are connected. When the second housing is removed from the first housing, the first and second interlock terminals are first disconnected and then the first and second power terminals are disconnected.

Accordingly, the first and second interlock terminals are connected only after the first and second power terminals are connected, and thus application of supplied power is allowed only when the first and second interlock terminals are connected. Therefore, occurrence of arc due to the high-voltage current is prevented by the pre-connection of the first and second power terminals. Also, when the first and second power terminals are disconnected, arcing is prevented as the first and second interlock terminals are already disconnected and thus the power is disconnected.

However, for the conventional connector as above in which application and disconnection of power depends on whether or not the first and second interlock terminals are connected when the second housing is inserted into or removed from the first housing, it is difficult for an operator to know if the first and second interlock terminals are connected or disconnected according to insertion or removal of the second housing, and therefore it is difficult to check if high-voltage power is applied to the first and second interlock terminals.

DISCLOSURE

Technical Problem

Therefore, the present invention has been made in view of the above problems, and it is an object of the present invention to provide a high voltage connector allowing a user to check from the outside whether a high-voltage current is applied to power terminals by a rotational cover housing.

It is another object of the present invention to provide a high voltage connector in which a cap housing is coupled to a cover housing such that as the cover housing rotates, the cap housing is raised or downward in operative connection with rotation of the cover housing, and only the cover housing is allowed to rotate.

It is another object of the present invention to provide a high voltage connector in which the cap housing is allowed to be inserted into a plug housing by rotation of the cover housing coupled to the plug housing.

It is another object of the present invention to provide a high voltage connector allowing the cover housing to be coupled to the plug housing.

It is another object of the present invention to provide a high voltage connector in which rotation of the cover housing is guided.

It is another object of the present invention to provide a high voltage connector allowing the position of the cover housing to be fixed when the cover housing is rotated and inserted into the downside of the plug housing.

It is a further object of the present invention to provide a high voltage connector allowing check of connection and disconnection of the power switch or the interlock switch through the radius of rotation of the cover housing.

Technical Solution

A high voltage connector of the present invention to achieve the objects as described above includes a plug housing provided with a power connection terminal and an interlock connection plug installed therein, a cap housing provided therein with a power connection terminal tab connectable with the power connection terminal and an interlock connection tab connectable with the interlock connection plug, the cap housing being inserted into the plug housing, and a cover housing installed at an upper portion of the cap housing and adapted to rotate for insertion or withdrawal of the cap housing into or from the plug housing such that the power connection terminal tab and interlock connection tab are connected with or disconnected from the power connection terminal and interlock connection plug.

Advantageous Effects

As the present invention allows a cap housing to be inserted into or removed from a plug housing by rotation of a cover housing, it is possible to check from the outside the connection of power connection terminals and interlock terminals by the degree of rotation of the cover housing when the power connection terminals and the interlock terminals are connected or disconnected in operative connection with rotation of the cover housing and further, since the connection of the power connection terminals and the interlock terminals can be checked, connection and disconnection of the connector can be exactly implemented, and thereby the present invention has an effect of preventing an accident such as electric shock due to incomplete connection or disconnection of the connector.

Further, the present invention is capable of connecting or disconnecting the power connection terminals and interlock terminals installed in the cap housing by ensuring that the cap housing coupled to the cover housing does not rotate while the cover housing rotates.

Further, the present invention is capable of stably connecting and disconnecting the power connection terminals and the interlock connection terminals by guiding ascent and descent of the cap housing in an insert coupling groove of the plug housing into which the lower end of the cap housing is inserted.

Further, as the cover housing is pivotably coupled to the plug housing, the present invention is capable of causing electric power to be disconnected or applied by upward or downward movement of the cap housing which occurs when the cover housing is inserted into or removed from the plug housing.

Moreover, as a rotation guide hole is formed along the path of rotation of the cover housing such that a rotational-coupling protrusion of the plug housing can rotate with the cover housing inserted thereinto, the present invention is capable of constraining the radius of rotation of the cover housing as well as guiding rotation of the cover housing.

Further, as a protrusion insertion hole and the rotation guide hole form a predetermined angle therebetween when the rotational-coupling protrusion is inserted into the protrusion insertion hole, the present invention is capable of preventing the rotational-coupling protrusion from being displaced from the protrusion insertion hole by allowing the rotational-coupling protrusion to be held at the edge portion of the rotational coupling protrusion arranged between the protrusion insertion hole and the rotation guide hole by the angle, thereby preventing sudden cutoff of power in the situation in which electric current is applied.

Further, as the present invention provide a display unit on the upper surface of the plug housing to display the radius of rotation of the cap housing, it is easy to check connection of power connection terminals in addition to connection of interlock terminals.

BEST MODE

Hereinafter, exemplary embodiments of the present invention will be described in detail with reference to the accompanying drawings.

Figure 1:
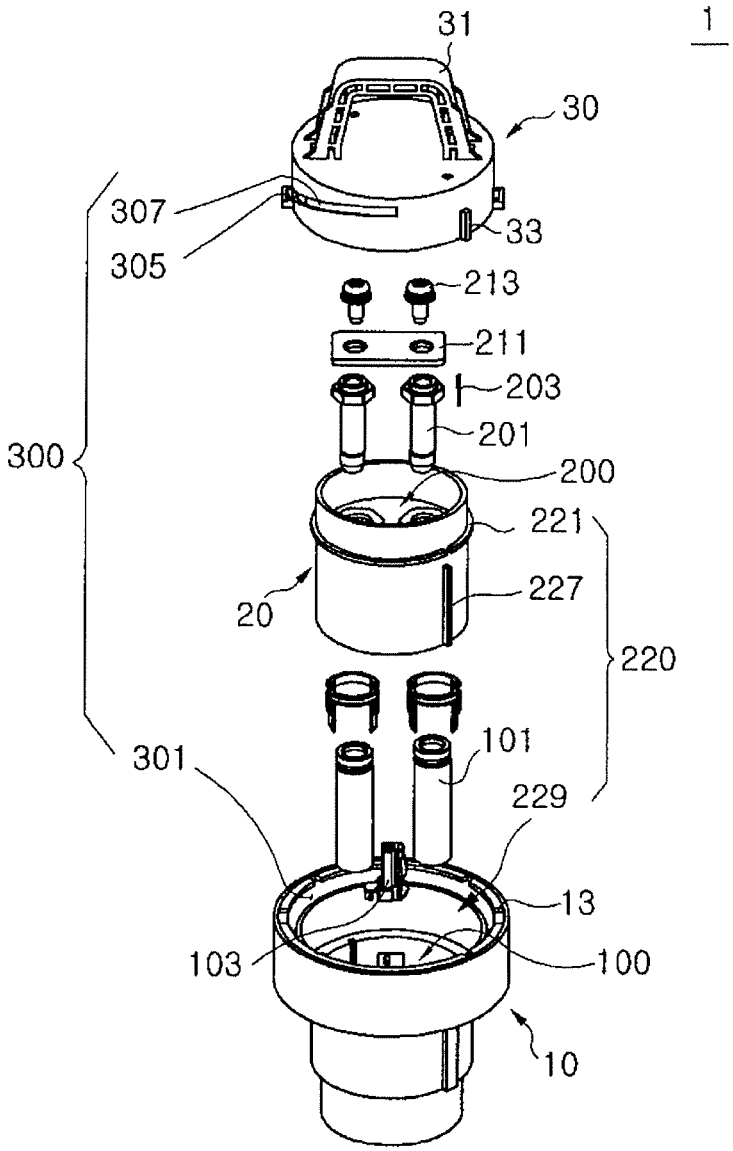
FIG. 1 is a view illustrating a high voltage connector according to the present invention.
Figure 2:
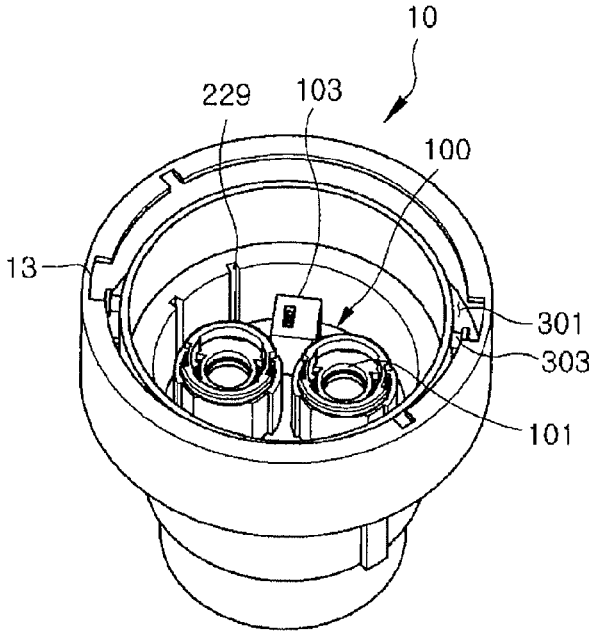
FIG. 2 is a view illustrating a plug housing of the high voltage connector according to the present invention.

FIG. 1 is a view illustrating a high voltage connector according to the present invention, and FIG. 2 is a view illustrating a plug housing of the high voltage connector according to the present invention.

Figure 3:
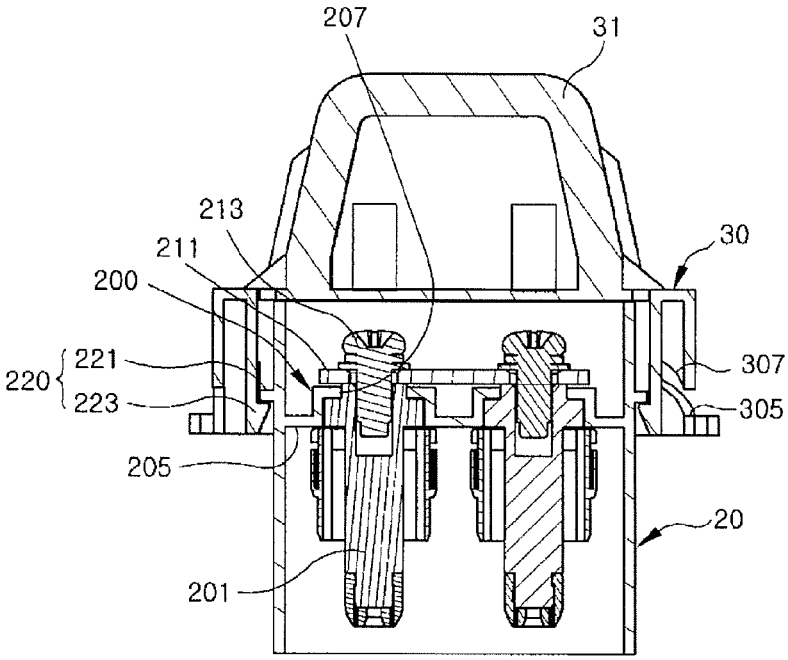
FIG. 3 is a view illustrating coupling between a cap housing and cover housing of the high voltage connector according to the present invention.
Figure 4A:
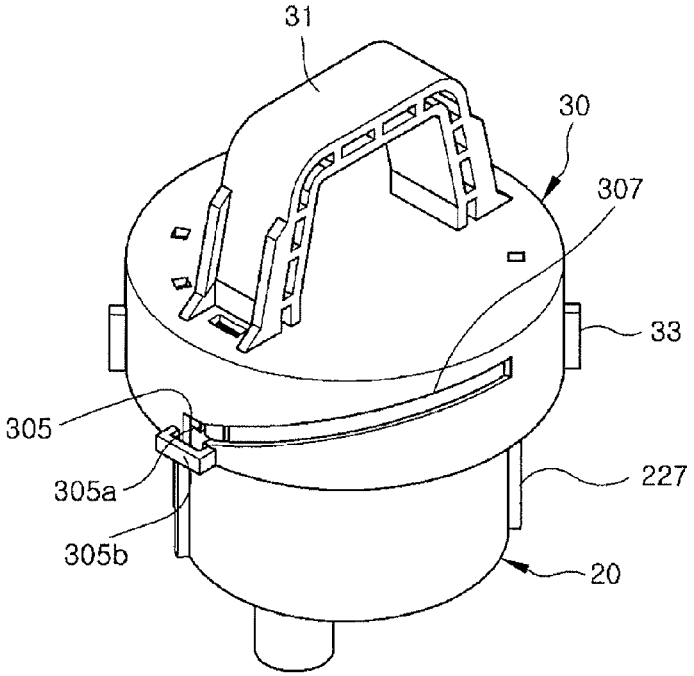
FIGS. 4A, 4B and 4C are views illustrating a means for coupling the cover housing and plug housing of the high voltage connector according to the present invention.
Figure 4B:
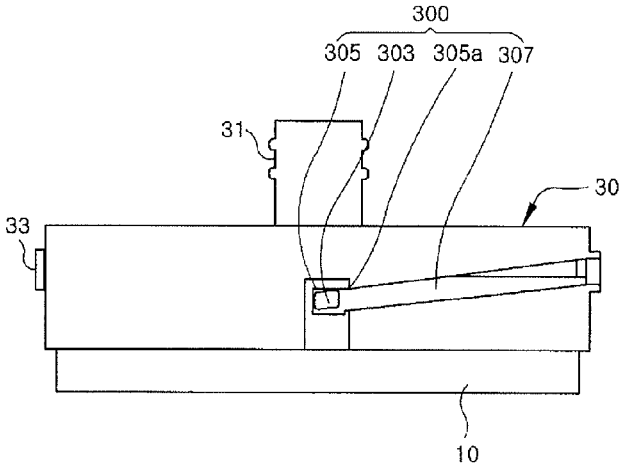
Figure 4C:
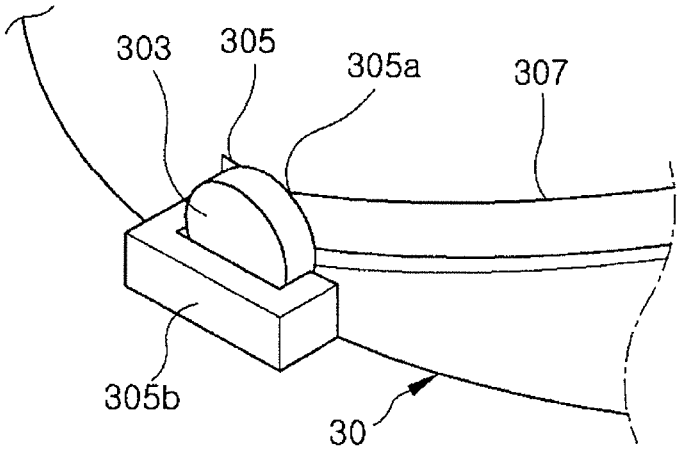

FIG. 3 is a view illustrating coupling between a cap housing and cover housing of the high voltage connector according to the present invention, and FIGS. 4A, 4B and 4C are views illustrating a means for coupling the cover housing and plug housing of the high voltage connector according to the present invention.

As shown in the figures, a connector 1 having an interlock switch includes a plug housing 10 provided with a power connection terminal 101 and interlock connection plug 103 installed therein, a cap housing 20 inserted into the plug housing 10 and provided with a power connection terminal tab 201 inserted into the power connection terminal 101 and an interlock connection tab 203 inserted into the interlock connection plug 103 and having a shorter length than the power connection terminal tab 201, and a cover housing 30 installed at an upper side of the cap housing 20 and adapted to rotate for insertion or removal of the cap housing 20 into or from the plug housing 10 such that the power connection terminal tab 201 and interlock connection tab 203 are connected with or disconnected from the power connection terminal 101 and interlock connection plug 103.

As shown in FIG. 2, the plug housing 10 is provided at an inner lower portion thereof with a plug installation portion 100 for installation of the power connection terminal 101 and interlock connection plug 103, and the inside of the plug installation portion 100 is adapted for installation of a pair of cylindrical power connection terminals 101 inserted thereinto and having the interlock connection plug 103 installed at one side thereof.

The plug installation portion 100 is preferably adapted for vertical installation of the cylindrical power connection terminals 101 therein.

Also, formed at an upper portion of the plug housing 10 is an insertion guide groove 13 into which an insertion guide protrusion 33 formed at the outer circumference of the cover housing 30, which will be described later, is inserted, the insertion guide protrusion 33 being adapted to guide insertion of the cover housing 30.

As shown in FIG. 3, the cap housing 20 is shaped in a pipe having the open top and bottom, and is provided therein with a terminal tab installation portion 200. The power connection terminal tab 201 and interlock connection tab 203 are installed at the terminal tab installation portion 200 to be inserted into or withdrawn from the power connection terminal 101 and interlock connection plug 103 installed at the plug installation portion 100 described above to allow electric power to be applied or cut off.

The terminal tab installation portion 200 includes an installation plate 205 adapted to divide the cap housing 20 into an upper portion and a lower portion, and a pair of installation holes 207 for installation of the power connection terminal tab 201 in which the power connection terminal tab 201 penetrates the cap housing 20 from the upper portion to the lower portion when inserted into the installation plate 205. A bus bar 211 is installed at the upper side of the power connection terminal tabs 201 which are inserted into the installation holes 207 and installed, and is coupled with the respective power connection terminal tabs 201 by bolts 213.

The bus bar 211 which allows a large amount of electric current to be applied thereto can be replaced with a fuse which is adapted to break away to cut off the electric current if the electric current is applied with a voltage over a certain level.

Also, the interlock connection tab 203 is installed at the terminal tab installation portion 200. The interlock connection tab 203 is preferably adapted to have a shorter length than that of the power connection terminal tab 201 so that the interlock connection plug 103 may not be connected with the interlock connection tab 203 at the first stage of connection at which the power connection terminal 101 is connected with the power connection terminal tab 201.

In addition, as the power connection terminal tab 201 is installed in a manner that allows the cap housing 20 to be inserted in the plug housing 10, the installation allows a part of the end of the power connection terminal tab 201 to remain in the power connection terminal 101.

The cover housing 30 is adapted to cover the upper side of the cap housing 20 described above when installed and to be coupled with the cap housing 20, and is provided with a coupling means 220 allowing only the cover housing 30 to rotate to apply pressure to the cap housing 20. Also, the cover housing 30 is preferably provided with a rotation lever member 31 at the top thereof so that the cover housing 30 can be easily held and rotated.

The coupling means 220 includes a coupling protrusion formed in a ring shape at an outer circumference of the cap housing 20 to protrude outward and surround the outer circumference of the cap housing 20, a stopping protrusion 223 formed at a position inside the cover housing 30 corresponding to the position of the coupling protrusion so as to be inserted into the plug housing 10 and held at the lower surface of the coupling protrusion, a guide protrusion 227 formed at the outer surface of the cap housing 20 to extend vertically and protrude outward, and a guide groove 229 formed at the inner surface of the plug housing 10 to correspond to the guide protrusion 227 to allow insertion of the guide protrusion 227 thereinto.

Also, as shown in FIG. 4A, the insertion guide protrusion 33 is formed at the outer surface of the cover housing 30 to protrude outward and an insertion guide groove 13 is formed in the plug housing 10 described above to correspond to the insertion guide protrusion 33 to allow insertion of the insertion guide protrusion 33 thereinto and thereby guide the cover housing 30 to the position where the cover housing 30 is coupled when inserted into the plug housing 10.

Here, the insertion guide groove 13 formed in the plug housing 10 is arranged at the upper surface of the plug housing 10 to allow the insertion guide protrusion 33 to be inserted thereinto and positioned in a cover housing insertion groove 301, thereby guiding the cover housing 10 to be coupled with the plug housing 10 in a manner that does not allow rotation of the plug housing 10 while allowing rotation of the cover housing 10.

Accordingly, the cap housing 20 is coupled with the cover housing 30 such that the stopping protrusion 223 of the cover housing 30 is held at the lower surface of the coupling protrusion of the cap housing 20, and when the cover housing 30 rotates according to insertion of the guide protrusion 227 of the cap housing 20 into the guide groove 229 of the plug housing, the cap housing 20 does not rotate and is pressed by the cover housing 30 to ascend and descend using the guide protrusion 227 formed to vertically extend and the guide groove 229.

The plug housing 10 and cover housing 30 are provided with a cover housing 300 which couples the plug housing 10 to the cover housing 30, allowing only the cover housing 30 to rotate to press the cap housing 20 and guiding rotation of the cover housing 30.

As shown in FIG. 4A, the cover housing 300 includes a cover housing insertion groove 301 formed at the inner surface of the plug housing 10 and allowing the cover housing 30 to be inserted thereinto in a manner that the outer surface of the cover housing 30 contacts the inner surface of the plug housing 10, a rotational coupling protrusion 303 formed in the plug housing 10 to protrude to the cover housing insertion groove 301, a protrusion insertion hole 305 formed at the lower portion of the outer surface of the cover housing 30 to allow the rotational coupling protrusion 303 to be inserted thereinto, a rotation guide hole 307 adapted to extend from the protrusion insertion hole 305 having the rotational coupling protrusion 303 inserted thereinto to guide rotation of the cover housing 30.

As the rotation guide hole 307 is formed in a spiral shape corresponding to the radius of rotation to allow natural rotation of the cover housing 30, a protrusion stopper 305*a* is formed at a portion extending from the protrusion insertion hole 305.

More specifically, the protrusion insertion hole 305 is arranged parallel with the cover housing 30, but the rotation guide hole 307 is bent at a predetermined angle, and therefore the section at which the protrusion insertion hole 305 and the rotation guide hole 307 adjoin each other does not form a smooth curve, but forms the protrusion stopper 305*a* with an edge.

Thereby, once the rotational coupling protrusion 303 is inserted into the protrusion insertion hole 305 which serves as the start point from which the rotation guide hole 307 extends, displacement of the rotational coupling protrusion 303 from the protrusion insertion hole 305 is blocked by the protrusion stopper 305*a*, and therefore cutoff of power can be maintained between the power connection terminal 101 and power connection terminal tab 201 and between the interlock connection plug 103 and interlock connection tab 203.

Further, when the operator forces the cover housing 30 to rotate, the rotational coupling protrusion 303 can be displaced from the protrusion stopper 305*a* by the pressure applied thereto and rotate along the spiral rotation guide hole 307, sequentially connecting the power connection terminal 101 with the power connection terminal tab 201 and in turn the interlock connection plug 103 with the interlock connection tab 203 to allow power to be applied.

The plug housing 10 is preferably provided with at least three indication portions A, B and C arranged to have a predetermined angle therebetween when the cover housing 30 is inserted into the plug housing 10.

This is intended to allow easy check of connection between the power connection terminal 101 and power connection terminal tab 201 and between the interlock connection plug 103 and interlock connection tab 203 through check of the position of the rotated rotation lever member 31 of the cover housing 30 or degree of rotation of the rotation lever member 31.

Figure 5A:
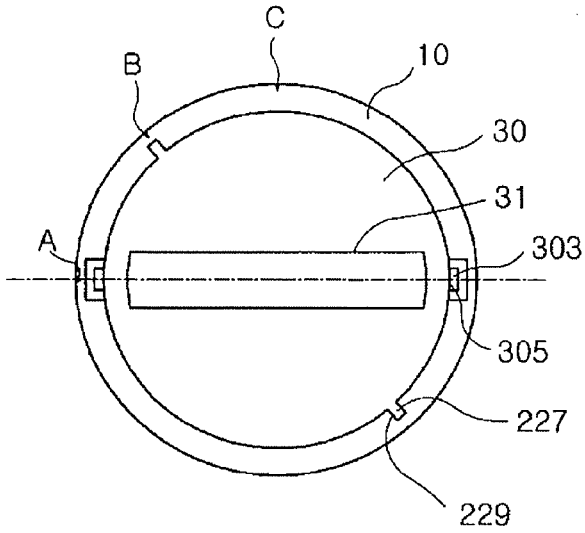
FIGS. 5A, 5B and 5C are views illustrating disconnection of the high voltage connector according to the present invention.
Figure 5B:
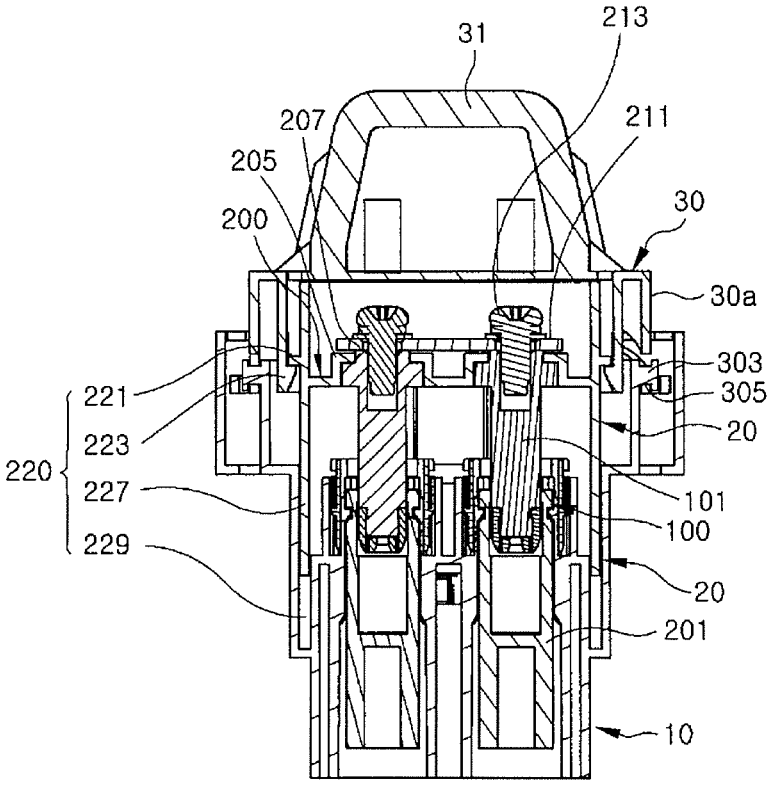
Figure 5C:
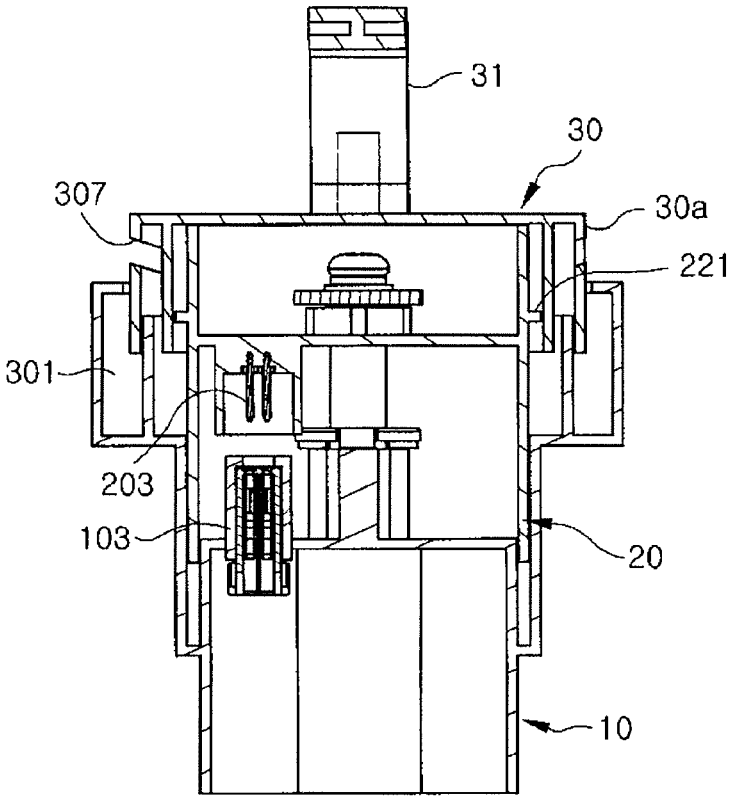
Figure 6A:
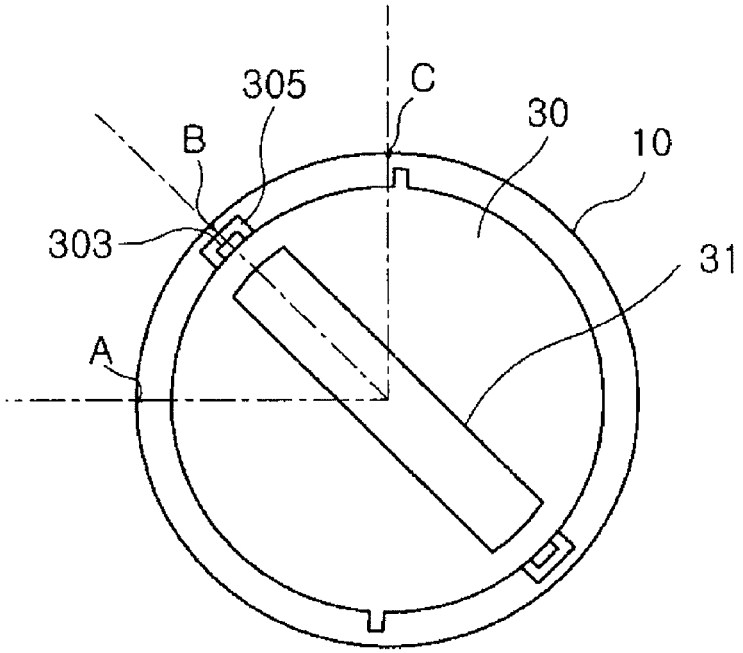
FIGS. 6A, 6B and 6C are views illustrating partial rotation of the high voltage connector according to the present invention.
Figure 6B:
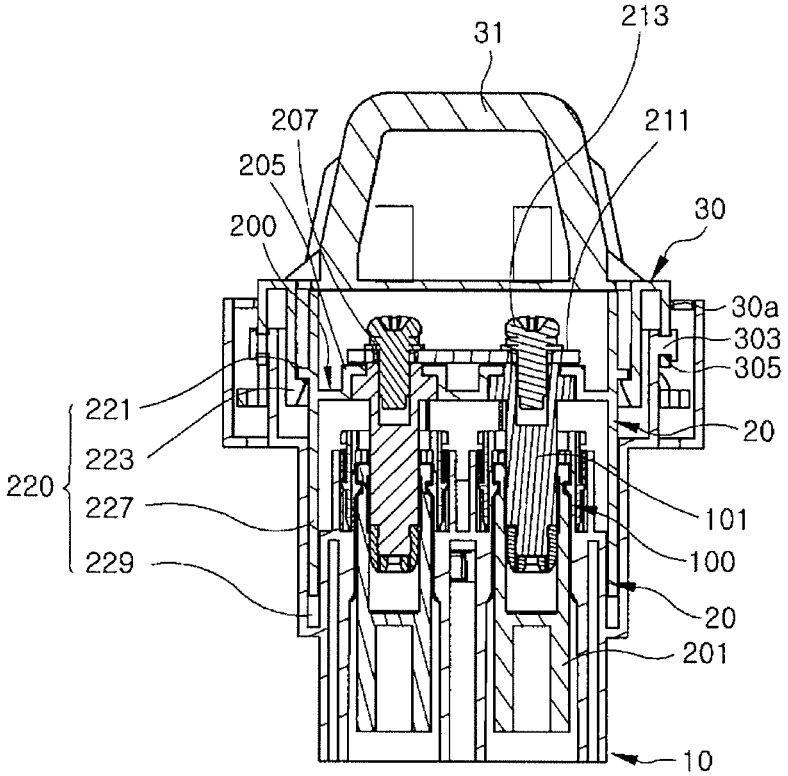
Figure 6C:
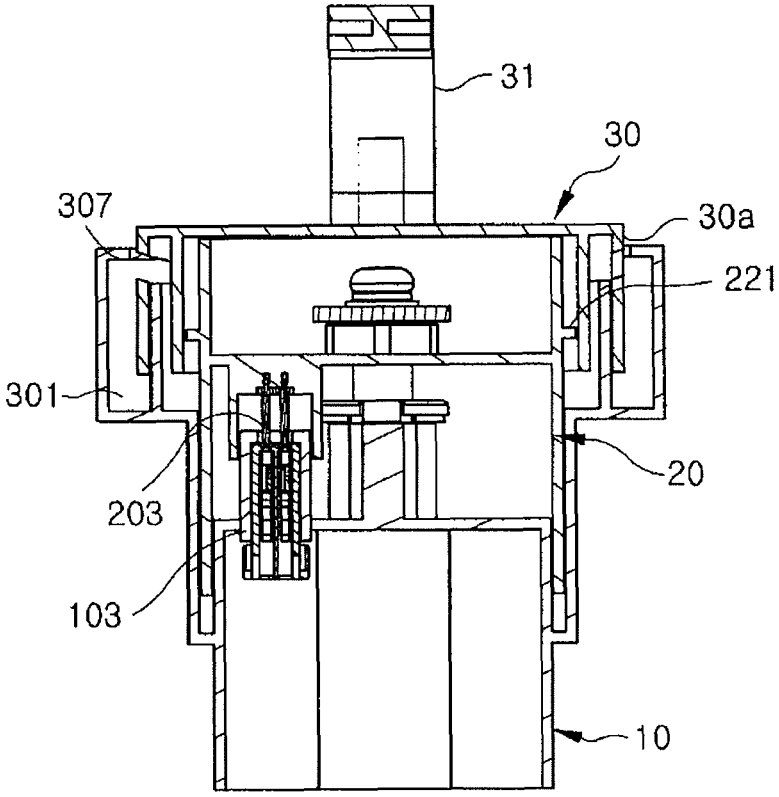
Figure 7A:
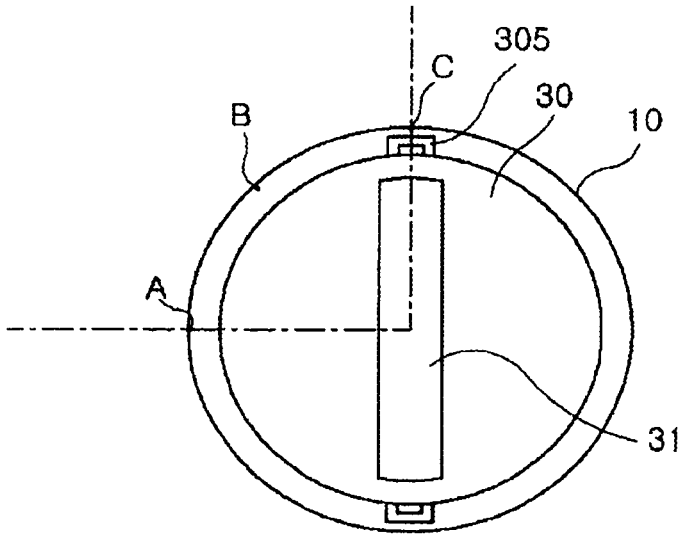
FIGS. 7A, 7B and 7C are views illustrating connection of the high voltage connector according to the present invention by rotation.
Figure 7B:
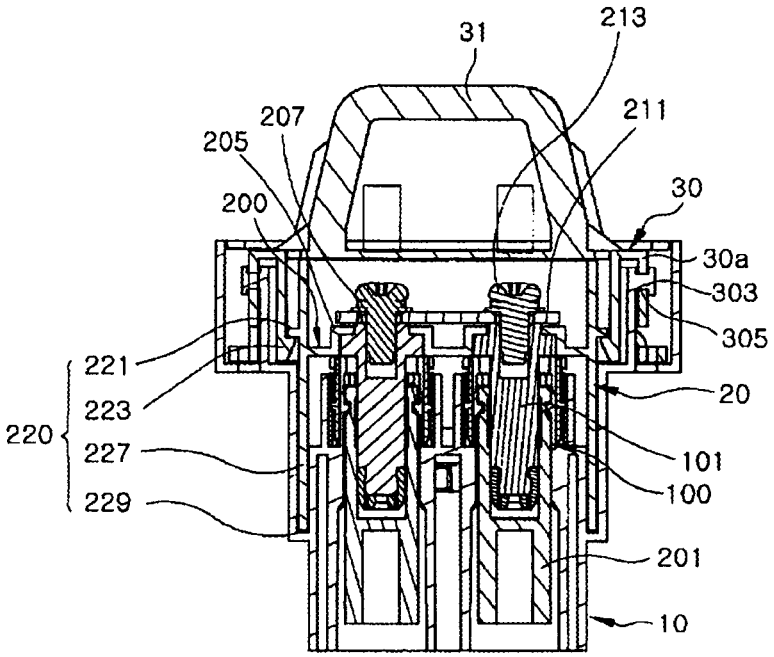
Figure 7C:
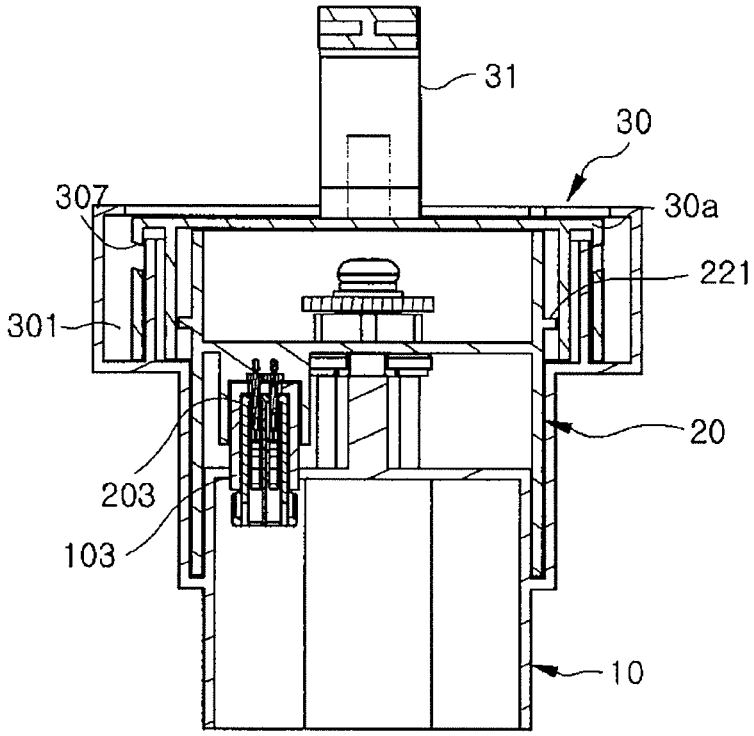

FIGS. 5A, 5B and 5C are views illustrating disconnection of the high voltage connector according to the present invention, FIGS. 6A, 6B and 6C are views illustrating partial rotation of the high voltage connector according to the present invention, and FIGS. 7A, 7B and 7C are views illustrating connection of the high voltage connector according to the present invention by rotation.

Hereinafter, operation of the high voltage connector according to the present invention and effects thereof will be described in detail with reference to the accompanying drawings.

When the power to the high voltage connector 1 is cut off, the rotation lever member 31 is positioned at the indication portion A as shown in FIG. 5A. As shown in FIG. 5B, when part of the cap housing 20 is inserted into the plug housing 10 from the top side of the plug housing 10, the lower end of the power connection terminal tab 201 installed at the terminal tab installation portion 200 of the cap housing 20 is partially inserted into the upper end of the power connection terminal 101 installed in the plug installation portion 100 of the plug housing 10.

The cap housing 20 is coupled such that the stopping protrusion 223 of the cover housing 30 is locked by the coupling protrusion of the cap housing 20, and in this operation, the guide protrusion 227 formed at the outer surface of the cap housing 20 is inserted into the guide groove 229 of the plug housing 10, and the insertion guide protrusion 33 formed at the outer surface of the cover housing 30 is inserted into the insertion guide groove 13 formed in the plug housing 10.

Then, the rotational coupling protrusion 303 is stopped by the edge portion formed at the point at which the protrusion insertion hole 305 meets the rotation guide hole 307 adapted to extend from the protrusion insertion hole 305, i.e., the protrusion stopper 305*a*, and is thus not allowed to be displaced from the position thereof and thereby cutoff of power is maintained.

Accordingly, the power connection terminal tab 201 and interlock connection tab 203 of the cap housing 20 can be positioned to correspond to the power connection terminal 101 and interlock connection plug 103 of the plug housing 10 to be connected to or disconnected from.

With reference to FIG. 5C, the interlock connection plug 103 and interlock connection tab 203 having shorter lengths than the power connection terminal 101 and power connection terminal tab 201 remain not contacting each other.

Also, as the guide protrusion 227 formed at the outer surface of the cap housing 20 is inserted into the guide groove 229 of the plug housing 10, if the operator rotates the rotation lever member 31 to allow the rotational coupling protrusion 303 to leave the protrusion stopper 305*a* such that the rotation lever member 31 is positioned at the indication portion B as shown in FIG. 6A, the rotational coupling protrusion 303 of the cap housing 20 inserted into the protrusion insertion hole 305 of the cover housing 30 rotates along the rotation guide hole 307 formed in a spiral shape to cause part of the cap housing 20 to be inserted into the plug housing 10.

Specifically, as the guide protrusion 227 formed at the outer surface of the cap housing 20 is inserted into the guide groove 229 of the plug housing 10, the cap housing 20 cannot rotate but is pressed by rotation of the cover housing 30 to be inserted into the plug housing 10.

Then, the power connection terminal tab 201 of the cap housing 20 is inserted into the power connection terminal 101 of the plug housing 10 and connected thereto as shown in FIG. 6B, while the interlock connection tab 203 is not connected with the interlock connection plug 103 as shown in FIG. 6C.

Next, as shown in FIG. 7A, when the rotation lever member 31 is further rotated by the operator to be positioned at the indication portion C, the rotational coupling protrusion 303 of the cap housing 20 inserted into the protrusion insertion hole 305 of the cover housing 30 rotates along the rotation guide hole 307 in a spiral shape to cause the cap housing 20 to be completely inserted into the plug housing 10.

Thereby, the power connection terminal tab 201 of the cap housing 20 is completely inserted into the power connection terminal 101 of the plug housing 10 and connected thereto as shown in FIG. 7B, and the interlock connection tab 203 is also connected with the interlock connection plug 103 to allow power to be applied as shown in FIG. 7C.

When the power is to be cut off, which is performed in a reverse order, the rotation lever member 31 is rotated to disconnect the interlock connection tab 203 from the interlock connection plug 103 and then the power connection terminal 101 from the power connection terminal tab 201 to cut off power.

As such, in connecting or disconnecting the power connection terminal 101 and power connection terminal tab 201 to which high-voltage current is applied through the operations described above, the interlock connection plug 103 and interlock connection tab 203 are allowed to be connected to or disconnected from each other before the power connection terminal 101 and power connection terminal tab 201 to which low current is applied are connected to or disconnected from each other, and therefore the high voltage connector 1 can prevent arcing.

The invention claimed is:

1. A high voltage connector comprising:

a plug housing provided with a power connection terminal and an interlock connection plug installed therein;

a cap housing provided therein with a power connection terminal tab connectable with the power connection terminal and an interlock connection tab connectable with the interlock connection plug, the cap housing being inserted into the plug housing;

a cover housing installed at an upper portion of the cap housing and adapted to rotate for insertion or withdrawal of the cap housing into or from the plug housing such that the power connection terminal tab and interlock connection tab are connected with or disconnected from the power connection terminal and interlock connection plug; and a rotational coupling means adapted to couple the plug housing to the cover housing and guide rotation of the cover housing to apply pressure to the cap housing.

2. The high voltage connector according to claim 1, further comprising a coupling means to couple the cap housing with the cover housing to allow only the cover housing to rotate when the cap housing is inserted into or withdrawn from the plug housing by rotation of the cover housing.

3. The high voltage connector according to claim 2, wherein the coupling means comprises:

a coupling protrusion formed at an upper side of the cap housing to protrude outward and adapted to surround an outer surface of the cap housing;

a stopping protrusion formed in the cover housing to stop the coupling protrusion;

a guide protrusion formed to vertically extend at the outer surface of the cap housing; and a guide groove formed at an inner surface of the plug housing such that the guide protrusion is inserted thereinto.

4. The high voltage connector according to claim 1, wherein the rotational coupling means comprises:

a cover housing insertion groove formed at an inner surface of the plug housing to allow the cover housing to be inserted thereinto;

a rotational coupling protrusion formed in the plug housing to protrude to the cover housing insertion groove; and a protrusion insertion hole formed at an outer surface of the cover housing to allow the rotational coupling protrusion to be inserted thereinto.

5. The high voltage connector according to claim 4, wherein the rotational coupling means further comprises a rotation guide hole formed at the outer surface of the cover housing to extend from the protrusion insertion hole such that when the cover housing rotates, the rotational coupling groove rotates along the rotation guide hole.

6. The high voltage connector according to claim 5, wherein the rotation guide hole is formed in a spiral shape.

7. The high voltage connector according to claim 5, wherein the rotational coupling means further comprises a protrusion stopper formed in an edge shape at a position at which the protrusion insertion hole adjoins the rotation guide hole.

8. The high voltage connector according to claim 5, wherein, if the rotational coupling protrusion remains inserted into the protrusion insertion hole, the power connection terminal and the interlock connection plug are disconnected from the power connection terminal tab and the interlock connection tab.

9. The high voltage connector according to claim 5, wherein, if the rotational coupling protrusion leaves the protrusion insertion hole and rotates along the rotation guide hole, the power connection terminal is connected with the power connection terminal tab, and then the interlock connection plug is connected with the interlock connection tab.

10. The high voltage connector according to claim 1, further comprising a rotation lever member arranged at an upper side of the cover housing.

11. The high voltage connector according to claim 1, wherein the plug housing is provided with a plurality of indication portions arranged with a predetermined angle therebetween.

12. The high voltage connector according to claim 1, wherein: the interlock connection plug is adapted to be shorter than the power connection terminal; and the interlock connection tab is adapted to be shorter than the power connection terminal tab.

13. The high voltage connector according to claim 1, wherein, when the cover housing rotates, the power connection terminal is connected with the power connection terminal tab, and then the interlock connection plug is connected with the interlock connection tab.

14. The high voltage connector according to claim 1, wherein, when the cover housing rotates, the interlock connection plug is disconnected from the interlock connection tab, and then the power connection terminal is disconnected from the power connection terminal tab.

* * * * *